US007862137B2

(12) United States Patent
Linville et al.

(10) Patent No.: US 7,862,137 B2
(45) Date of Patent: Jan. 4, 2011

(54) METHOD AND SYSTEM FOR AVOIDING BOTTOM OF PAGE PRINTING ARTIFACTS

(75) Inventors: Kenneth W. Linville, Lexington, KY (US); Michael A. Marra, III, Lexington, KY (US); Randall D. Mayo, Georgetown, KY (US); John T. Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1134 days.

(21) Appl. No.: 10/957,093

(22) Filed: Sep. 30, 2004

(65) Prior Publication Data

US 2006/0066651 A1 Mar. 30, 2006

(51) Int. Cl.
*B41J 29/38* (2006.01)
*B41J 23/00* (2006.01)
*B41J 2/01* (2006.01)

(52) U.S. Cl. ..... 347/16; 347/9; 347/37; 347/104

(58) Field of Classification Search ..... 347/9, 347/16, 37, 104
See application file for complete search history.

(56) References Cited

U.S. PATENT DOCUMENTS

| | | | | |
|---|---|---|---|---|
| 5,351,068 | A | 9/1994 | Moon et al. | |
| 5,619,233 | A | 4/1997 | Harrington | |
| 6,464,319 | B1 * | 10/2002 | Teshigawara et al. | 347/19 |
| 6,631,976 | B2 | 10/2003 | Hamamoto et al. | |
| 6,650,436 | B1 | 11/2003 | Hamamoto et al. | |
| 6,733,101 | B2 | 5/2004 | Katayama et al. | |
| 6,741,831 | B2 | 5/2004 | Seto | |
| 6,742,451 | B1 | 6/2004 | Junghans | |
| 6,744,456 | B2 | 6/2004 | Fisher et al. | |
| 2003/0047609 | A1 | 3/2003 | Endo et al. | |
| 2003/0122891 | A1 | 7/2003 | Hamamoto et al. | |
| 2003/0206224 | A1 * | 11/2003 | Sakakibara et al. | 347/108 |
| 2004/0207708 | A1 * | 10/2004 | Ohashi et al. | 347/104 |
| 2005/0012800 | A1 * | 1/2005 | Ohashi | 347/104 |

* cited by examiner

*Primary Examiner*—Matthew Luu
*Assistant Examiner*—Jannelle M Lebron
(74) *Attorney, Agent, or Firm*—John Victor Pezdek

(57) ABSTRACT

Method and devices for reducing printing artifacts. In one embodiment, a method includes directing ink onto a medium, the medium having a trailing edge; tracking the position of the medium in relation to a nip roller; adjusting the direction of ink onto the medium a first time when the trailing edge of the medium is in close proximity to the nip roller; and adjusting the direction of ink onto the medium a second time.

5 Claims, 7 Drawing Sheets

50
Sub-scan Axis
70
y
Scan Axis
72
x
MEMORY
65
PROCESSOR
64
PRINTHEAD
63
SENSOR
66
MOTOR
61
NIP
52
PRINT MEDIA
68
68a
68b
59a
EXIT ROLLER
59b
59
MIDFRAME
56
58
FEEDROLL
54
55
MOTOR BUS
62

METHOD AND SYSTEM FOR AVOIDING BOTTOM OF PAGE PRINTING ARTIFACTS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

Embodiments of the invention relate to methods and systems of printing to reduce print artifacts due to media movement error at the bottom of the page.

2. Description of the Related Art

A common problem in printers is the occurrence of print artifacts at the bottom of the page due to unintended movement of the media during and after feedroll-to-exit-roller transfer. The feedroll is a transport mechanism that initiates the movement of a piece of print media through the printing apparatus. The feedroll may include two rollers turning in opposite directions that are configured to grip the edge of a piece of print media and send it through the printing apparatus. The exit roller mechanism, on the other hand, is the opposite of the feedroll and is configured to guide print media out of the printing apparatus. A large error (predominately in the Y or sub-scan direction) occurs when the trailing edge of the media (e.g., a sheet of paper) leaves the nip of the feedroll, commonly referred to as a "nip jump," and is under the sole guidance of the exit-roll. Printing artifacts are created due to changes in feed rate resulting from changes in the number and type of transport mechanisms controlling the print media, specifically at the time the media enters or exits one of the transport mechanisms. Printing artifacts can be more prevalent in high quality edge-to-edge print modes on glossy media. Often, these are the modes where the desire for defect-free printing is the highest.

SUMMARY OF THE INVENTION

Embodiments of the invention provide a method of reducing printing artifacts. One method includes printing on print media using a first set of nozzles; controlling movement of the print media out of a feedroll nip; and printing on the print media using a second set of nozzles. Another method includes printing on print media using a first set of nozzles; detecting a nip jump; and printing on the print media using a second set of nozzles.

Another embodiment provides a system for reducing printing artifacts. The system includes a printing apparatus that includes a feedroll configured to feed print media to the printing apparatus, a nip roller configured to feed print media to the printing apparatus, an exit roller configured to feed print media out of the printing apparatus, and a printhead including a plurality of nozzles, where each on of the plurality of nozzles applies a printing substance to the print media. The system further includes a driver configured to provide directions to move the print media between the feedroll, the nip roller, and the exit roller, to instruct a first set of the plurality of nozzles to apply a printing substance to the print media before a nip jump, and to instruct a second set of the plurality of nozzles to apply a printing substance to the print media after the nip jump.

Yet another embodiment provides a printing apparatus. The printing apparatus includes a feedroll configured to feed print media to the printing apparatus; a nip roller configured to feed print media to the printing apparatus; an exit roller configured to feed print media out of the printing apparatus; a printhead including a plurality of nozzles, where each one of the plurality of nozzles applies a printing substance to the print media; and a processor configured to provide directions to move the print media between the feedroll, the nip roller, and the exit roller in a longitudinal direction, to instruct a first set of the plurality of nozzles to apply a printing substance to the print media before a nip jump, and to instruct a second set of the plurality of nozzles to apply a printing substance to the print media after the nip jump.

Another embodiment provides a printhead configured to print an image on a print media. The printhead includes a plurality of nozzles configured to apply a printing substance to a print media; and a controller configured to instruct the printhead to use a first set of the plurality of nozzles to apply a print substance to the print media before a nip jump and to use a second set of the plurality of nozzles to apply a print substance to the print media after the nip jump.

Yet another embodiment provides computer-readable media containing instructions for determining a first set of nozzles, printing on the print media with the first set of nozzles before a nip jump, determining a second set of nozzles, and printing on the print media with the second set of nozzles after the nip jump.

Additional embodiments provide a method for reducing printing artifacts. The method includes directing ink onto a medium, the medium having a trailing edge; tracking the position of the medium in relation to a nip roller; adjusting the direction of ink onto the medium a first time when the trailing edge of the medium is in close proximity to the nip roller; and adjusting the direction of ink on to the medium a second time.

Other features and advantages of embodiments of the invention will become apparent to those skilled in the art upon review of the following detailed description and drawings.

Figure 1:
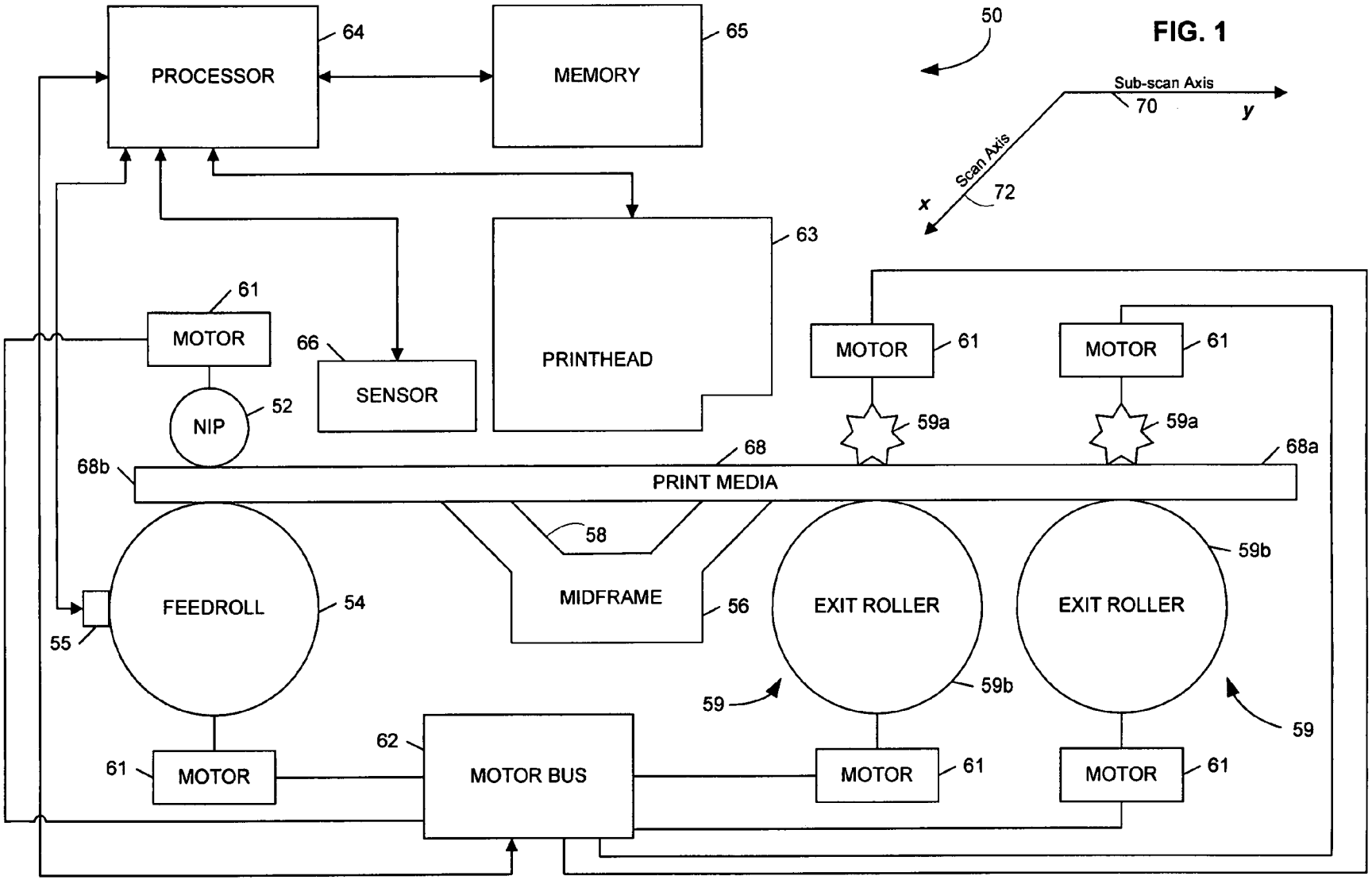
FIG. 1 is a schematic illustration of an exemplary printer mechanism for transporting print media.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

DETAILED DESCRIPTION

FIG. 1 illustrates schematically an exemplary printer mechanism 50 for transporting print media in and out of a printer. The mechanism 50 includes a nip roller 52, a feedroll 54, an encoder 55, a midframe 56, an edge-to-edge trough 58, two exit rollers 59 including two top exit rollers 59*a* and bottom exit rollers 59*b*, one or more motors 61 (shown schematically), a motor bus 62, a printhead 63, a processor 64, a memory module 65, and a sensor 66. The mechanism 50 transports print media 68, also seen in FIG. 1, in a sub-scan or y-axis direction 70 while the printhead 63 moves in a scan or x-axis direction 72 as it directs ink onto the print media 68. The print media 68 has a leading edge 68*a* and a trailing edge 68*b*.

In some embodiments, the nip roller 52 and feedroll 54 turn in opposite directions under the operation of the motor 61 and the counter rotations push the print media 68 between the nip roller 52 and feedroll 54 and forward or into the printer mechanism 50.

After being fed by the nip roller 52 and feedroll 54, the print media 68 moves to the midframe 56. The midframe supports the print media 68 while the printhead 63 directs printing substance, such as ink, to the media 68 while moving in the X direction (i.e., into and out of the page as shown in FIG. 1). In the case of edge-to-edge printing, the printhead 63 directs ink beyond the edge of the print media 68 in order to ensure the edge of the print media 68 is fully covered. For example, as the print media 68 moves through the mechanism 50, the printhead 63 may continue to direct ink out of the nozzles after the trailing edge 68*b* of print media 68 passes the printhead 63. The edge-to-edge trough 58 provides a reservoir to collect excess ink supplied by the printhead 63 when print media 68 is not present.

Figure 2:
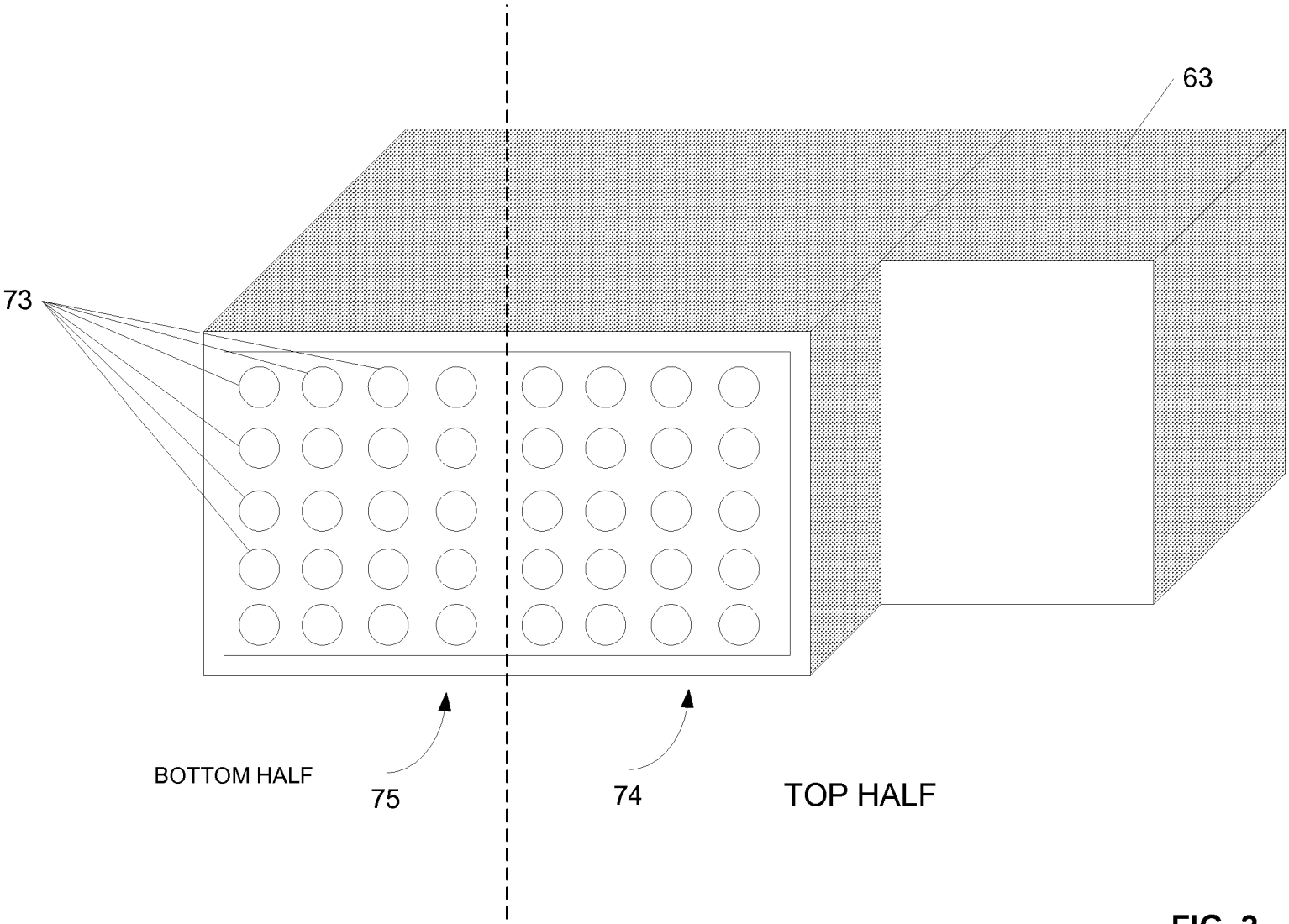
FIG. 2 is a bottom, perspective view of a printhead.

In some embodiments, the printhead 63 includes one or more nozzles 73 that direct ink to the print media 68 (see FIG. 2). For example, a typical CMY (Cyan, Magenta, and Yellow) printhead can have 160 nozzles per color, spaced at 1/600 inch intervals in the sub-scan direction. Different colors of ink directed by the printhead 63 such as cyan, magenta, yellow, or black, may be directed through different nozzles 73. The nozzles 73 may be positioned in columns. The printhead 63 illustrated in FIG. 2 includes five columns of nozzles 73 (illustrated horizontally) each containing eight nozzles 73. In some embodiments, the printhead 63 controls the nozzles 73 that are "active" and the nozzles 73 that are "turned off." Only the nozzles 73 activated by the printhead 63 direct ink to the print media. For example, the nozzles 73 may be controlled based on where they are located. Nozzles 73 in a top half 74 of the nozzles 73, which are the rows containing the half of the nozzles 73 that are closest to the exit rollers 59, and a bottom half 75 of the nozzles 73, which are the rows containing the half of the nozzles 73 that are closest to the nip roller 52 and feedroll 54, may be activated differently. The printhead 63 may turn off the top half 74 and activate the bottom half 75, turn off the bottom half 75 and activate the top half 74, or activate or turn off both the top half 74 and the bottom half 75. The printhead 63 may also create other regions of nozzles 73 and activate and turn off particular regions such as the top three fourths (¾) of the nozzles 73 and the bottom three fourths (¾) of the nozzles 73, every other row, every second row, every third nozzle 73 of every row, every third nozzle 73 of every other row, and the like.

After the printhead 63 applies ink to the print media 68, the print media 68 travels through the exit rollers 59. The top exit rollers 59*a* in the mechanism 50 are optional. Because the top exit rollers 59*a* contact the printed surface of the print media shortly after the ink has been applied, they are designed to have minimum contact with the printed surface when gripping the print media. Typically, rowel spurs, also called starwheels, are used to minimize contact. However, when used, the top exit rollers 59*a* and bottom exit rollers 59*b* can rotate under the direction of one or more motors 61 in a similar manner as the nip roller 52 and feedroll 54. It should be noted that a single exit roller 59 may also be used instead of multiple exit rollers 59. It should also be apparent that additional components may be used in the mechanism 50 such as ink dryers, multiple printheads, multiple nip rollers, feedrolls, exit rollers, and the like. The components may also be arranged in a variety of configurations. For example, the nip roller 52, feedroll 54, and exit rollers may be positioned to flip the print media and return it to the direction it came from or send the print media past the printhead 63 twice, in order to print both sides of the print media 68 or apply multiple ink layers.

In some embodiments, the motors 61 control the movement of the print media 68 by operating the nip roll 52, the feedroll 54, and the exit rollers 59. In some embodiments, the printer mechanism 50 includes a separate motor 61 for each roller and the processor 64 supplies control instructions to the motor bus 62, which forwards signals to the individual motors 61. The processor 64 may also directly supply control signals to each individual motor 61 without using the motor bus 62. The printer mechanism 50 may also include a single motor 61 that controls all of the rollers.

The processor 64 may be a microprocessor, programmable logic control, application specific integrated circuit, or the like configured to receive input (e.g., instructions and feedback signals) and provide output (e.g., control signals). The input to the processor 64 may come from the memory module 65, the encoder 55, the motors 61, the printhead 63, and/or the sensor 66. The memory module 65 may contain non-volatile memory such as one or more forms of ROM, one or more disk drives, RAM, other memory, or combinations of the foregoing. In some embodiments, the memory module 65 stores program code or instructions, and the processor 64 fetches the instructions and outputs control instructions based on the execution of the fetched instructions to components of the printer mechanism 50. The encoder 55 attached to the feedroll 54 may be a sensor that tracks the movement of the feedroll 54 and, as a result, the movement of the print media 68. The encoder may supply movement parameters of the feedroll 54 to the processor 64, and the processor 64 may adjust the operation of the printer mechanism 50 based on the provided movement parameters. For example, if the data provided by the encoder 55 indicates that the feedroll 54 is rotating too fast and transporting the print media 68 into the printer mechanism 50 too quickly, the processor 64 may generate and send a control signal to the motor 61 and/or the printhead 63 to adjust the rotation of the feedroll 54 or the movement of the printhead 63, respectively.

In some embodiments, the sensor 66 provides tracking of the print media 68 as it moves through the printer mechanism 50. The sensor 66 can provide positional information to the processor 64 regarding the movement of the print media 68. The sensor 66 can provide information as to the position of an approaching leading edge 68*a* or trailing edge 68*b* of print media 68, a print media 68 jam, a speed of the moving print media 68, the dimensions of the print media 68, and the like. As described for the encoder, the processor 64 may use the information obtained and provided by the sensor 66 to adjust the operation of the printer mechanism 50.

As print media 68 moves through the mechanism 50, one or more of the rollers (e.g., the nip roller 52, the feedroll 54, and/or the exit rollers 59) controls its movement. For example, when the print media 68 is first fed into the printer mechanism 50, the nip roller 52 and feedroll 54 control the movement of the print media 68. Eventually, however, the leading edge 68*a* of the print media 68 moves past the mid-frame and moves between one of the exit rollers 59. After the leading edge 68*a* reaches one of the exit rollers 59, and depending on the length of the print media 68 and the position of the rollers, the print media's movement is controlled by the nip roller 52, the feedroll 54, and one of the exit rollers 59.

Figure 4:
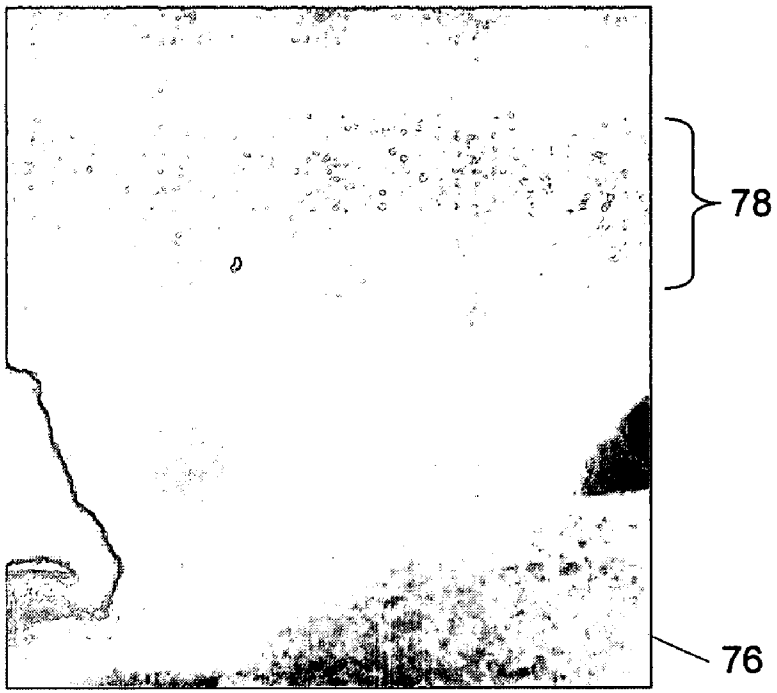
FIG. 4 is a portion of an exemplary printed image with a print defect.
Figure 3:
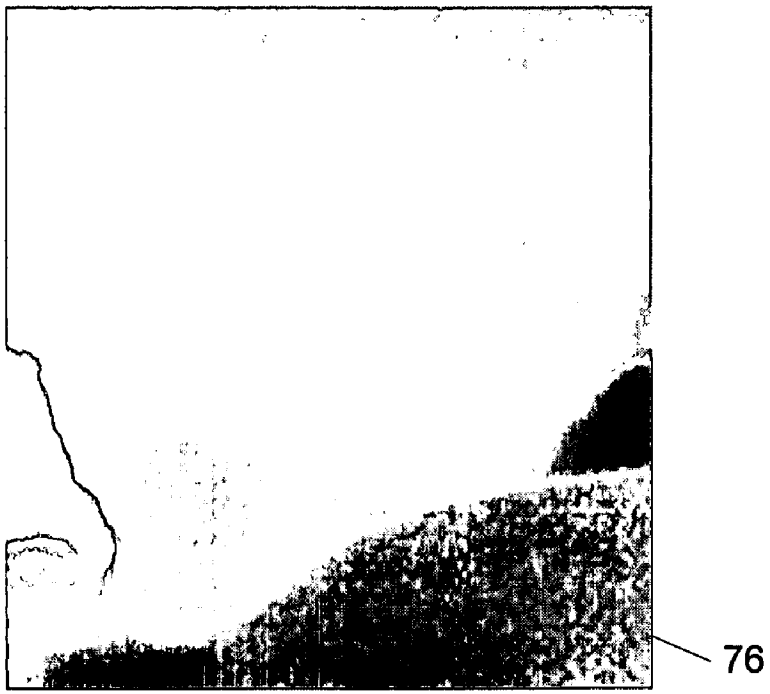
FIG. 3 is a portion of an exemplary printed image without a print defect.

The nip roller 52, the feedroll 54, and one or more of the exit rollers 59 continue to direct the movement of the print media 68 until the trailing edge 68*b* of the print media 68 moves out of and past the nip roller 52 and feedroll 54. The release of the trailing edge 68*b* of the print media from the nip roller 52 and the feedroll 54 ("the feedroll nip") can cause the print media 68 to jump ahead in the sub-scan direction 70 more than necessary as one or more exit rollers 59 become the sole controllers of the print media. This movement is often called a "nip jump" and can cause what are referred to as "bottom of the page artifacts" or defects. The extra movement of the print media 68 can cause misalignment of the printhead 63 and the print media 68 since the print media moved more than the printhead 63 is aware of or configured to operate according to. The printhead 63 is configured to direct ink to the print media 68 as the print media 68 moves through the mechanism 50 incrementally, at "normal" indexes. An "abnormal index," such as occurs during the nip jump, can cause portions of the print media to move past the printhead 63 where they do not receive ink. The skipped portions can appear lighter or discolored in comparison to the surrounding printed image since the skipped portions either do not receive an application of ink, or receive a misaligned application of ink. A portion of an exemplary printed image 76 without a nip jump defect is illustrated in FIG. 3. The image 76 with a nip jump defect 78 is illustrated in FIG. 4. The defect 78 appears lighter and less continuous and smooth than the surrounding printed image because of a misaligned application of ink is directed by the printhead 63 due to the abnormal movement or jump of the print media 68 as the trailing edge 68*b* leaves the nip roller 52 and feedroll 54.

Figure 5:
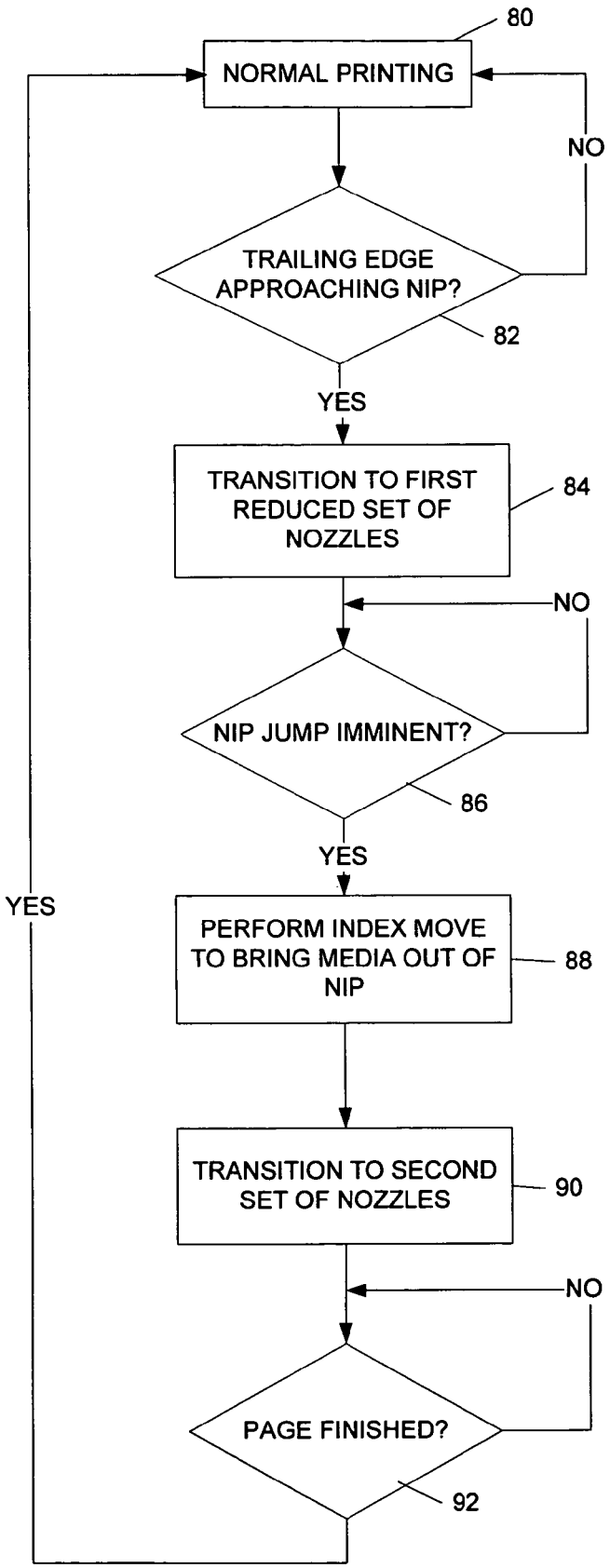
FIG. 5 is a flow chart illustrating an exemplary method for avoiding print defects.

FIG. 5 is a flow chart illustrating an exemplary method of reducing or eliminating nip jump defects 78. The first step of the method presented in FIG. 5 involves the printer mechanism 50 performing "normal" printing (block 80). As the print media 68 passes through the mechanism 50, the print media's movement and the printhead's movement are configured to keep both components aligned. For example, during "normal" printing, the print media 68 may be moved forward through the mechanism 50 at regular increments and times, and the printhead 63 may direct ink toward the print media 68 at regular locations and times governed by the incremental movement of the print media 68. Any imprecise movement of the print media 68 can cause improper operation of the printhead 63 since the components are no longer aligned. "Normal" printing as referred to in block 80, may include operating the printer mechanism 50 as configured without adjusting for past misalignments or preparing for possible future misalignments.

At block 82, the printer mechanism 50 determines if the trailing edge 68*b* of the print media 68 is approaching the nip roller 52. In some embodiments, the trailing edge 68*b* is considered to be approaching the nip roller 52 if the trailing edge 68*b* is within approximately 0.75 inch from the nip roller 52. The position of the trailing edge 68*b* may also be determined with reference to the printhead 63. In some embodiments, the printhead 63 is located 0.5 inch ahead (toward the exit rollers 59) of the nip roller 52, and the trailing edge 68*b* is considered approaching the nip roller 52 when the trailing edge 68*b* is approximately 1.25 inches from the printhead 63. The distance between the nip roller 52 and the trailing edge 68*b* may also be varied to account paper size, the size of the nip roller 52, the size and position of the printhead 63, and the like. The printer mechanism 50 can include sensors or tracking devices, such as the sensor 66, that indicate the position of the print media 68. The printer mechanism 50 can also calculate the position by knowing the length of the print media 68 and how far the print media 68 has already been transported through the mechanism 50. If the trailing edge 68*b* of the print media is not approaching the nip roller 52, the printer mechanism 50 continues to print normally. If, however, the trailing edge 68*b* is nearing the nip roller 52, the printer mechanism adjusts the nozzles 73 of the printhead 63 that are directing ink to the print media 68 (block 84). In some embodiments, the printer mechanism 50 reduces the number of nozzles 73 used by the printhead 63 to half the total available nozzles 73. For example, as noted above, since a typical CMY printhead can have a total of 160 nozzles per color, the printer mechanism 50 may "turn off" half of the nozzles 73 so that only 80 nozzles 73 are directing ink to the print media 68. The printer mechanism 50 can also specify the nozzles 73 of the printhead 63 that should remain "on" or active and those that should be turned off. In some embodiments, the nozzles 73 of the printhead 63 are arranged in rows and specific nozzles 73 within certain rows or specific entire rows may be turned off or left active. The printer mechanism 50 can turn off half of the rows of nozzles 73 and can leave half of the rows active. In some embodiments, the printer mechanism 50 turns off the top half 74 of the nozzles 73 and leaves on or activates the bottom half 75 of the nozzles 73 to prepare for any misalignment that may occur during a nip jump (see FIG. 2). For example, utilizing the illustrated printhead of FIG. 2, which has a total of 40 nozzles distributed among 8 rows, the printer mechanism 50 turns off the top four rows of nozzles (the rows closest to the exit rollers 59) and leaves the bottom four rows of nozzles (the rows closest to the nip roller 52) active.

At block 86, the printer mechanism 50 determines if a nip jump is imminent. As described above, the printer mechanism 50 can include sensors or tracking devices that indicate the position of the trailing edge 68*b* of the print media 68 or the printer mechanism 50 can calculate the position since it knows the length of the print media 68 and how far the print media 68 has already been transported through the mechanism 50. When it is determined that a nip jump is imminent, the printer mechanism 50 makes an adjusting index move to bring the print media 68 out of the feedroll nip (block 88). The adjusting index move aligns the region of print media 68 previously addressed by the first set of nozzles 73 to now be addressed by the second set of nozzles 73. The adjusting index move is made through the rollers (e.g., the nip roller 52, the feedroll 54, or one or more of the exit rollers 59). The printer mechanism adjusts the operation of the motor 61 to modify the speed of one or more of the rollers to move the print media 68 through the nip jump. In some embodiments, the adjusting index move is equal to half the height of the printhead 63 plus the normal index move. For example, using a typical CMY printhead with 160 nozzles spaced at 1/600" and therefore a height of 320/1200" and a normal index of 7/1200", an adjusting index move equal to the normal index (7/1200") plus half the printhead height (160/1200") would be made (167/1200") to bring the print media 68 out of the feedroll nip. The adjusting index move avoids an unmanaged "jump" of the media 68 that can occur when the feedroll nip is trying to hold the edge of the media 68, and provides regulated movement of the print media that can be managed and accounted for by the printer mechanism 50. The adjusting index move aligns the region of the print media 68 previously addressed by the bottom half 75 of the nozzles 73 to now be addressed by the top half 74 of the nozzles 73 of the printhead 63.

Once the adjusting index move has been made, the printer mechanism 50 readjusts the nozzles 73 of the printhead 63 that are directing ink to the print media 68 (block 90). In some embodiments, the print media 68 moved past the bottom half 75 of the nozzles 73 of printhead 63 without receiving the proper application of ink, and is now aligned such that the top half 74 of the nozzles 73 of the printhead 63 can provide proper application of ink. The printer mechanism 50 activates the top half 74 of the nozzles 73 and turns off the bottom half 75 of the nozzles.

At block 92, the printer mechanism 50 determines if an image on the print media 68 has finished printing. Once an image is printed on the print media 68, the printer mechanism 50 can return to normal printing (block 80) in order to print another image on another piece of print media 68. In some embodiments, returning to normal printing may involve activating all of the nozzles 73 of the printhead 63 instead of using only half.

Figure 6:
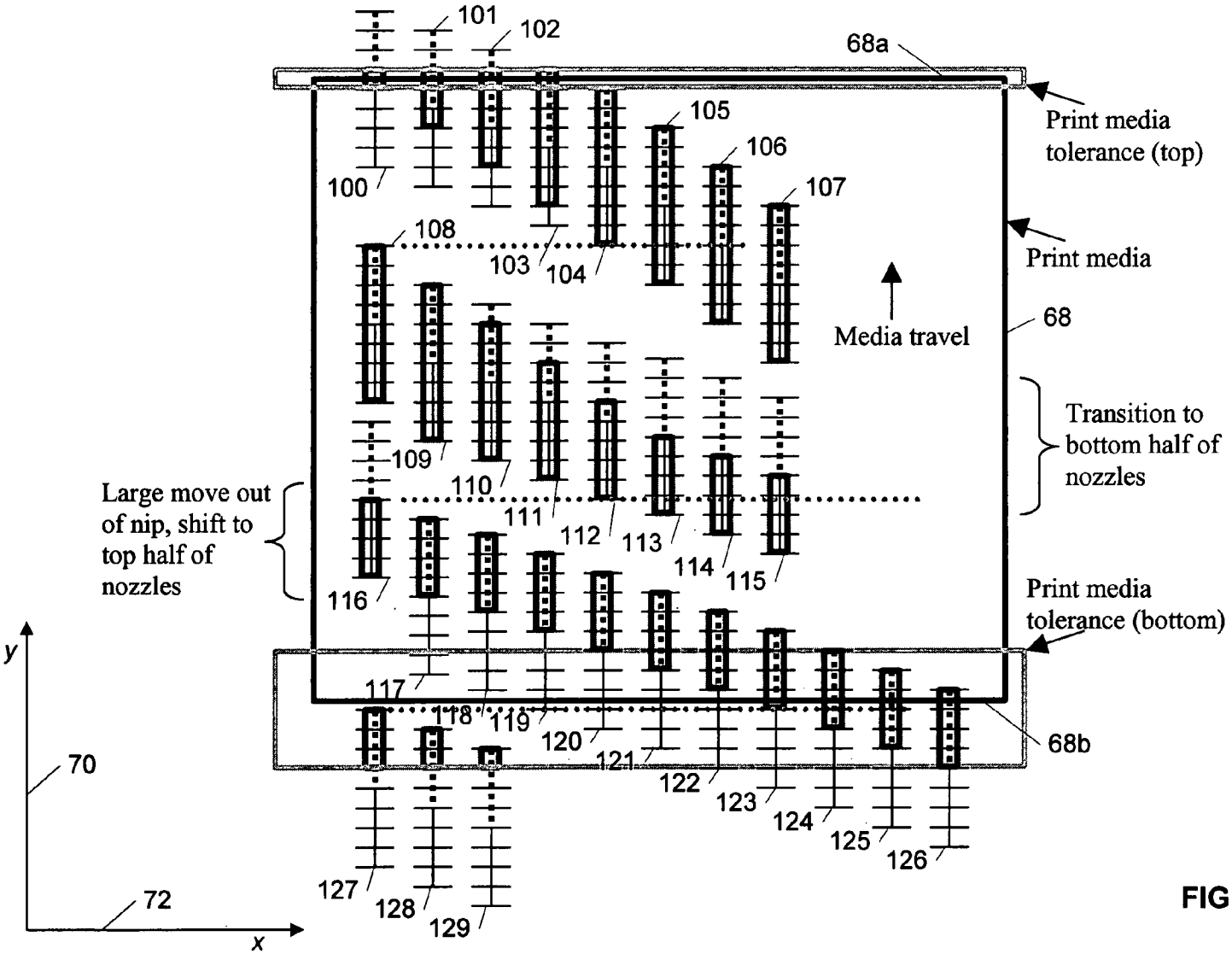
FIG. 6 graphically illustrates exemplary print media movement and corresponding printhead operation for the method shown in FIG. 5.

FIG. 6 provides a graphical representation of the method described in FIG. 5 for a four-pass print mode. In a four-pass print mode, the printhead 63 moves in the x-axis or main scan direction 72 across the print media 68 four times per region of the print media 68, such that each region of the print media 68 will be addressed four times by the nozzles 73 of the printhead 63. In between each main scan the print media 68 moves in the y-axis or sub-scan direction 70 through the mechanism 50. The print media 68 may move at regular indexes or increments and each increment aligns the print media 68 with the nozzles 73 of the printhead 63 to receive the next print swath. Exemplary print swaths 100-129 are also illustrated in FIG. 6. Each swath 100 through 129 represents the direction of ink by the printhead 63. The rows of nozzles 73 of the printhead 63 are also illustrated in each swath 100 through 129. For example, each swath 100 through 129 is divided into eight sections, which illustrate eight rows or groups of rows of nozzles 73 on the printhead 63. The active nozzles 73 or rows are also illustrated in each swath 100 through 129, indicated by the encompassing rectangle. Swaths 104 through 109 represent swaths generated during normal printing. At swath 110, as the trailing edge 68*b* of the print media 68 approaches the nip roller 52, the printer mechanism 50 begins to transition to a reduced nozzle usage. In particular, the printer mechanism 50 shifts to using the bottom half 75 of the nozzles 73 located in the rows of the printhead 63 closest to the trailing edge 68*b* of the print media 68. At swath 113 the transition is complete and only half of the nozzles 73 are active.

Between swaths 116 and 117, the printer mechanism 50 determines that a nip jump is imminent and the normal index move that would occur between swath 116 and swath 117 is adjusted or increased to bring the print media 68 out of the feedroll nip. As illustrated in FIG. 6, the print media 68 is shown to make a large move relative to the printhead 63 prior to printing swath 117.

After swath 116, nozzle usage is again adjusted. As seen in FIG. 6, the active nozzles 73 switch from the bottom half 75 for swath 116 to the top half 74 for swath 117. The top half 74 of the nozzles 73 located closest to the leading edge 68*a* of the print media 68 is used to print the rest of an image on the print media 68.

Figure 7:
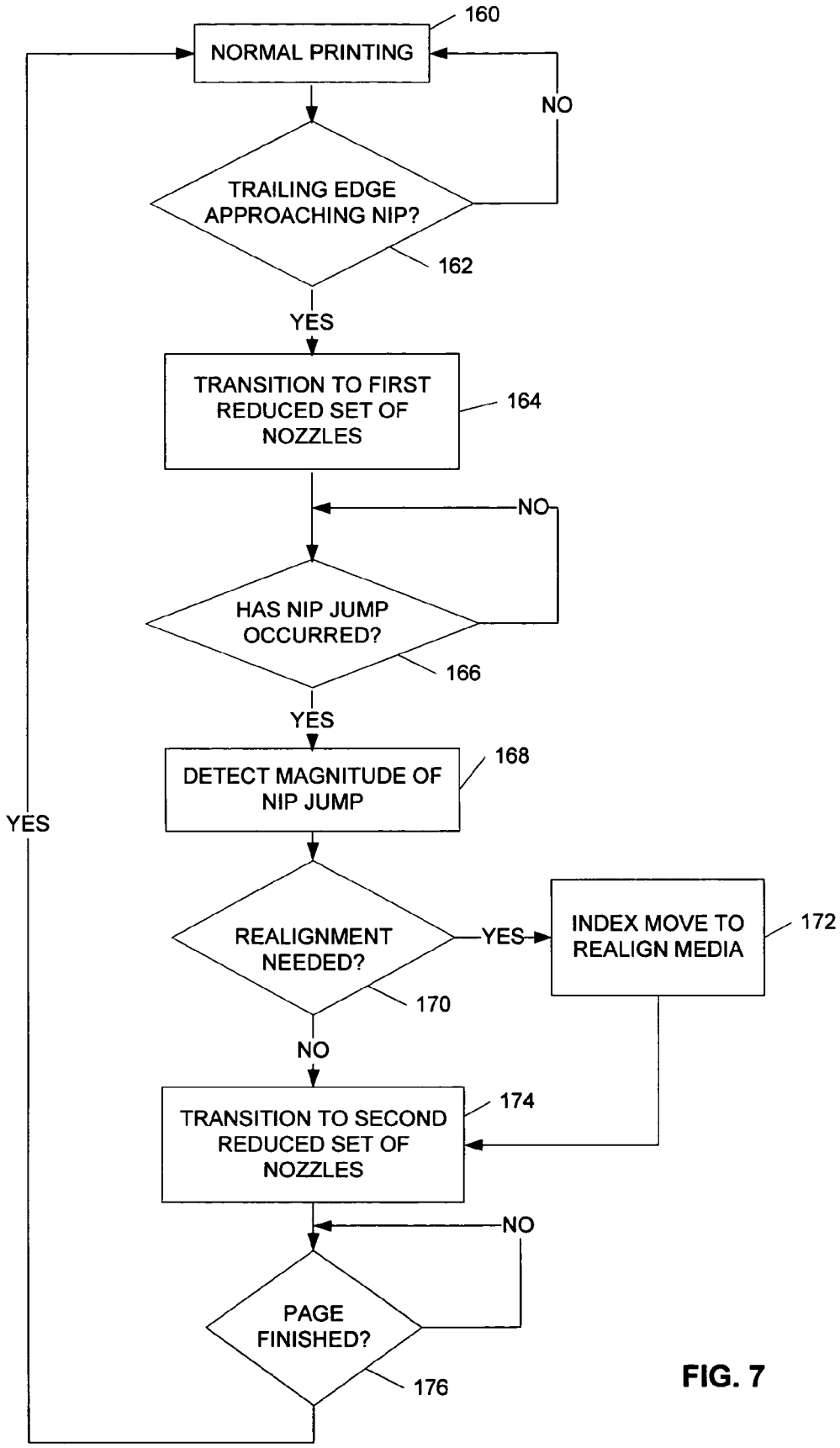
FIG. 7 is a flow chart illustrating another exemplary method for avoiding print defects.

FIG. 7 is a flow chart illustrating another exemplary method of reducing nip jump defects 78. The first step of the method presented in FIG. 7 again involves the printer mechanism 50 performing normal printing (block 160). As previously described, normal printing can involve operating the components of the printer mechanism 50 as configured without adjusting for past misalignments or preparing for future misalignments.

At block 162, the printer mechanism 50 determines if the trailing edge 68*b* of the print media 68 is approaching the nip roller 52. As described in the previous method, in some embodiments, the trailing edge 68*b* is considered to be approaching the nip roller 52 if the trailing edge 68*b* is within approximately 0.75 inch from the nip roller 52 or within approximately 1.25 inches from the printhead 63. It should be noted that other distances can be used. As also described in the previous method, the printer mechanism 50 can include sensors or tracking devices that indicate the position of the trailing edge 68*b* of the print media 68 or may calculate the position based on the length of the print media 68 and how far the print media 68 has already been transported through the mechanism 50. If the trailing edge 68*b* of the print media is not approaching the nip roller 52, the printer mechanism 50 continues to print normally. If, however, the trailing edge 68*b* is nearing the nip roller 52, the printer mechanism 50 adjusts the nozzles 73 of the printhead 63 that are applying ink to the print media 68 (block 164). As noted above for the previous method, in some embodiments, the printer mechanism 50 transitions the printhead 63 to use half of the nozzles 73 that are closest to the trailing edge 68*b* of the print media 68.

At block 166, the printer mechanism 50 determines if a nip jump has occurred. To determine if a nip jump has occurred, the printer mechanism 50 can include sensors or tracking devices that indicate the position of the trailing edge 68*b* of the print media 68. When it is determined that a nip jump has occurred, the printer mechanism 50 determines a magnitude of the nip jump (block 168). When a nip jump occurs, the feedroll 54 typically moves with the print media 68 and an encoder on the feedroll 54 reveals the magnitude or skipped distance of the nip jump. The printer mechanism 50 detects this magnitude and adjusts the nozzle usage of the printhead 63. In some embodiments, the printer mechanism can shift the active nozzles 73 from the half of nozzles 73 closest to the trailing edge 68*b* of the print media 68 by the magnitude of nip jump to realign the active nozzles with the print media.

In some embodiments, in order to compensate for the nip jump, an adjusting index move may be necessary before printing the next print swath to have the print media 68 positioned correctly for the leading half of the nozzles 73. The printer mechanism 50 can determine if an adjusting index move is needed at block 170 by analyzing the magnitude of the detected nip jump and/or the operating parameters of the printer mechanism 50. For example, if the magnitude of the nip jump is above a set threshold, the printer mechanism 50 can decide to adjust for the relatively large jump. In addition, if the print mode set on the printer mechanism 50 requires high resolution or error-free prints, such as photo modes, the printer mechanism 50 can decide to adjust the nip jump in order to create a substantially defect-free print.

If the printer mechanism 50 determines that an adjustment is necessary, the printer mechanism 50 calculates and performs an adjusting index move (block 172). The adjusting index move can be calculated by subtracting the magnitude of the nip jump (as measured by the encoder) from the height of half of the printhead 63. For example, using a typical CMY printhead with 160 nozzles and a height of $^{320}/_{1200}$", if the magnitude of the nip jump is $^{3}/_{1200}$", an adjusting index move of 160-3 or $^{157}/_{1200}$" is made to adjust for the nip jump. Note that while the above uses half the printhead, other proportions may be utilized such as ¾, where the nozzle usage would shift from the bottom three fourths of the nozzles to the top three fourths of the nozzles. In this case, the adjusting index move would be 80-3 or $^{77}/_{1200}$".

Once an adjusting index move is made, if necessary, the printer mechanism 50 adjusts the nozzles 73 of the printhead 63 used to direct ink to the print media 68 (block 174). In some embodiments, the printer mechanism 50 turns off the half of the nozzles 73 closest to the trailing edge 68*b* of the print media 68 and activates the half of the nozzles 73 that are closest to the leading edge 68*a* of the print media 68.

At block 176, the printer mechanism 50 determines if there is any more printing to be performed on the print media 68. Once printing is complete, the printer mechanism 50 returns to normal printing (block 160) in order to print another image on another piece of print media 68.

Figure 8:
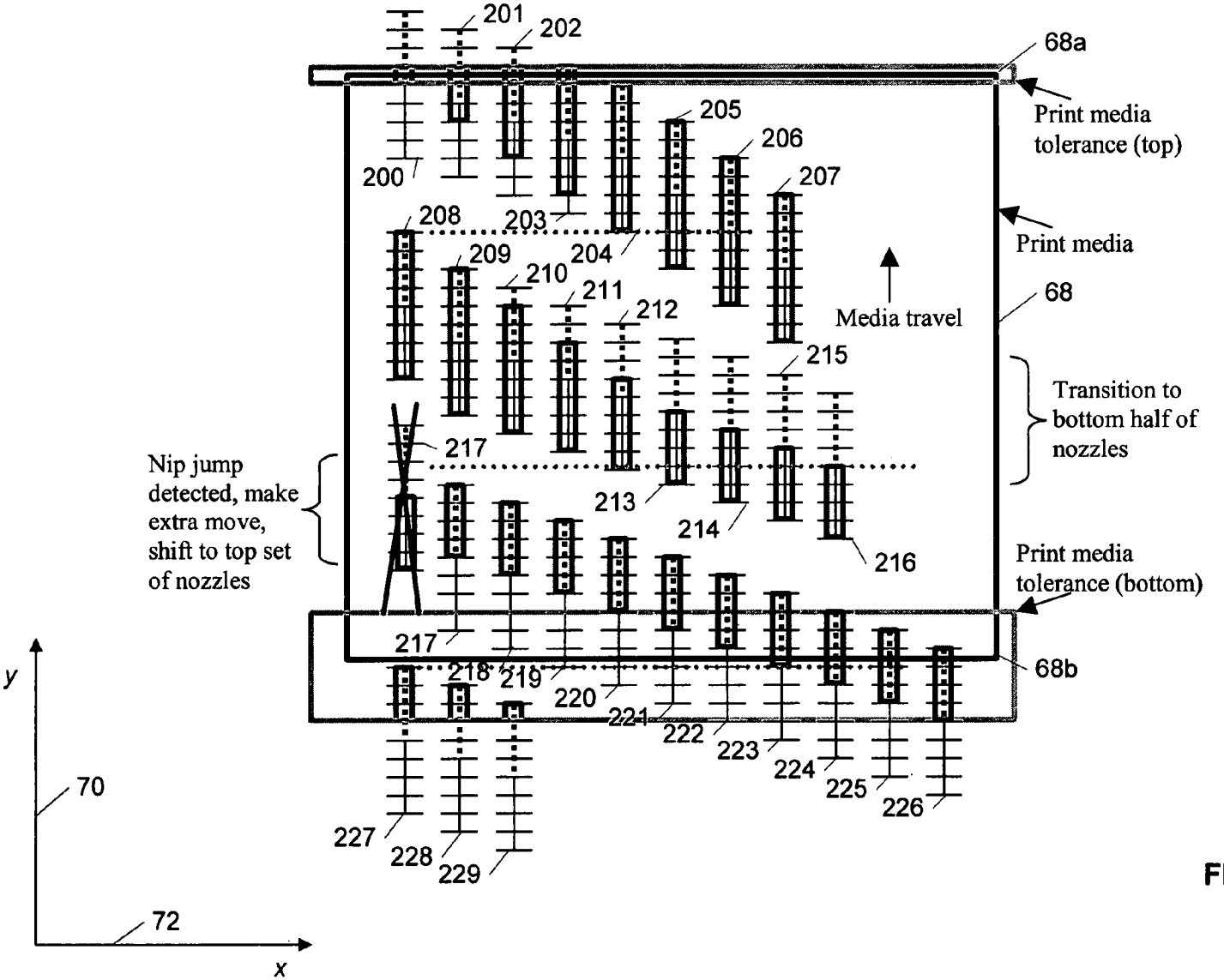
FIG. 8 graphically illustrates exemplary print media movement and corresponding printhead operation for the method shown in FIG. 7.

FIG. 8 provides a graphical representation of the method described in FIG. 7 for a four-pass print mode. As previously noted, in a four-pass print mode the printhead 63 moves in the x-axis or main scan direction 72 across the print media 68 four times per region of the print media 68, such that each region of the print media 68 will be addressed four times by the nozzles of the printhead 63. In between each main scan the print media 68 moves in the y-axis or sub-scan direction 70 through the mechanism 50. The print media 68 may move at regular indexes or increments and each increment aligns the print media 68 with the nozzles 73 of the printhead 63 to receive the next print swaths. Exemplary print swaths 200-229 are also illustrated in FIG. 8. Swaths 204-209 illustrate swaths generated during normal printing. At swath 210, as the trailing edge 68*b* of the print media 68 approaches the nip roller 52, the printer mechanism 50 begins to transition to a reduced nozzle usage. In particular, the printer mechanism 50 shifts to using the bottom half 75 of the nozzles 73. At swath 213 the transition is complete and only half of the nozzles 73 are active or in use.

Between swaths 216 and 217, the printer mechanism 50 detects a nip jump and makes an adjusting index move to the print media 68 to adjust for the magnitude of the nip jump. As illustrated in FIG. 8, the print media 68 is shown to make a large move relative to the printhead 63 prior to printing swath 217.

After making the adjusting index move, the printer mechanism 50 adjusts the nozzles 73 of the printhead 63 that are turned off or active. As seen in FIG. 8, the active nozzles 73 switch from the bottom half 74 to the top half 73 for swath 217. The top half 74 of the nozzles 73 is used to print the rest of an image on the print media 68.

One or both of the above two methods can be implemented in program code or instructions stored in the memory module 65 and may be executed by the processor 64 of the printer mechanism 50. The program code can also be stored external to the printer mechanism 50 such as on a client workstation and can be provided to the processor 64 over a communication line or network. As the processor 64 executes the instructions, it can supply control information, such as movement directions, speed directions, and nozzle usage directions, to the printhead 63, the nip roller 52, the feedroll 54, and the exit rollers 59. The processor 64 of the printer mechanism 50 can also be configured to modify or choose from instructions provided from an external or separate computing device such as a client workstation or driver.

The above methods can also be performed in a printer driver. The printer driver can be installed and executed on a client computer or workstation and can provide operational instructions to the printer mechanism 50 to perform the steps of the method. The printhead 63 of the printer mechanism 50 can also include a processor that controls the movement of the printhead 63 and the rollers.

Various features and advantages of the invention are set forth in the following claims.

The invention claimed is:

1. A method of reducing printing artifacts, the method comprising:

printing on print media using a first set of nozzles;

controlling movement of the print media out of a feedroll nip by a normal index move;

printing on the print media using a second set of nozzles; and setting an adjusting index move equal to half a height of a printhead plus the normal index move.

2. A method as claimed in claim 1, further comprising moving the print media by the adjusting index move.

3. A method as claimed in claim 2, further comprising ensuring the print media comes out of the feedroll nip during the adjusting index move.

4. Computer-readable media containing instructions for:

determining a first set of nozzles;

printing on the print media with the first set of nozzles before the print media exits a feedroll nip;

determining a second set of nozzles;

printing on the print media with the second set of nozzles after the print media exits the feedroll nip;

moving the print media out of the feedroll nip; and setting an adjusting index move equal to half a height of the printhead plus a normal index move.

5. Computer-readable media as claimed in claim 4, further comprising instructions for providing directions for moving the print media by the adjusting index move.

* * * * *